US008967728B2

(12) United States Patent
Stryffeler et al.

(10) Patent No.: US 8,967,728 B2
(45) Date of Patent: Mar. 3, 2015

(54) METHOD OF CONTROLLING A MINER TO CAUSE WOBBLE IN THE CUTTING HEADS

(75) Inventors: David Stryffeler, Franklin, PA (US); Don McDaniel, Clintonville, PA (US); Chris McCormick, Cranberry, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 755 days.

(21) Appl. No.: 13/104,695

(22) Filed: May 10, 2011

(65) Prior Publication Data

US 2012/0187743 A1 Jul. 26, 2012

Related U.S. Application Data

(60) Provisional application No. 61/435,027, filed on Jan. 21, 2011.

(51) Int. Cl.
*E21C 27/24* (2006.01)
*E21C 31/04* (2006.01)

(52) U.S. Cl.
CPC ..... *E21C 27/24* (2013.01); *E21C 31/04* (2013.01)
USPC ..... 299/1.4

(58) Field of Classification Search
USPC ..... 299/1.4, 29, 64, 31, 73, 1.8
See application file for complete search history.

(56) References Cited

U.S. PATENT DOCUMENTS

| | | | | | |
|---|---|---|---|---|---|
| 2,597,040 | A * | 5/1952 | Sloane | 299/67 |
| 2,705,626 | A * | 4/1955 | Ball | 299/64 |
| 2,730,182 | A * | 1/1956 | Sloane | 180/6.44 |
| 2,752,140 | A * | 6/1956 | Joy | 299/64 |
| 2,776,809 | A * | 1/1957 | Barrett | 299/18 |
| 2,798,712 | A * | 7/1957 | Ball | 299/68 |
| 2,818,243 | A * | 12/1957 | Leven | 299/68 |
| 2,942,863 | A * | 6/1960 | Joy | 299/56 |
| 2,973,949 | A * | 3/1961 | Densmore | 299/64 |
| 3,116,914 | A * | 1/1964 | Young et al. | 299/64 |
| 3,302,974 | A * | 2/1967 | Hlinsky | 299/1.4 |
| 3,469,885 | A * | 9/1969 | Marberg | 299/71 |
| 3,842,602 | A * | 10/1974 | Ziegler et al. | 60/327 |
| 4,192,551 | A * | 3/1980 | Weimer et al. | 299/1.4 |
| 4,669,786 | A * | 6/1987 | Morgan et al. | 299/76 |
| 5,143,423 | A * | 9/1992 | LeBegue et al. | 299/76 |
| 6,612,655 | B2 * | 9/2003 | Schwoebel et al. | 299/29 |
| 2011/0253502 | A1 | 10/2011 | Neilson et al. | |

FOREIGN PATENT DOCUMENTS

| | | |
|---|---|---|
| GB | 977944 | 12/1964 |

OTHER PUBLICATIONS

Search Report from the United Kingdom Intellectual Property Office for Application No. 1200903.1 dated Mar. 22, 2012 (3 pages).

* cited by examiner

*Primary Examiner* — Sunil Singh
(74) *Attorney, Agent, or Firm* — Michael Best & Friedrich LLP

(57) ABSTRACT

Methods, systems, and computer-readable media containing instructions for controlling a miner. One system includes a cutter head, a left tram system, a right tram system, and a cutter head controller. The cutter head includes a plurality of bits and a plurality of sections defining at least one recess. The left and right tram systems are configured to move the miner, and the cutter head controller is configured to vary a current speed of at least one of the left tram system and the right tram system to cause the cutter head to alternate back and forth to bring the plurality of bits into engagement with material accumulating within the least one recess.

25 Claims, 8 Drawing Sheets

METHOD OF CONTROLLING A MINER TO CAUSE WOBBLE IN THE CUTTING HEADS

RELATED APPLICATIONS

This application claims priority to U.S. Provisional Patent Application No. 61/435,027, filed Jan. 21, 2011, the entire contents of which are hereby incorporated by reference.

FIELD OF THE INVENTION

Embodiments of the invention relate to methods and systems for controlling a miner, such as a continuous miner.

SUMMARY OF THE INVENTION

A continuous miner typically includes a solid cutter drum or head that includes multiple sections. A recess, however, is formed between adjacent cutter head sections. The recess is caused by the web of the cutter head gear case where the gearing comes through to drive the cutter drum. Cutter bits included on the cutter head typically cannot reach material that enters the recess and, therefore, cannot break up material accumulating in the recess. The material left in the recess is often called the core. If the material being cut is soft, a core breaker installed in the recess typically can break the core away. However, if the material is hard, a core breaker has trouble breaking the core and the miner cannot sump into the material as effectively.

Accordingly, embodiments of the invention provide systems and methods for controlling a miner. One system varies the speed of left and right tram systems included in a continuous miner to make the cutter head alternate back and forth (e.g., left and right) while sumping into material. This alternating or "wobble" motion by the cutter head helps break up the core accumulating in the recess, which makes the miner more productive, especially when cutting hard material. Also, using the "wobble" motion may allow a miner to use different types of cutter heads rather than ryperveyor style cutters, such as drum style cutter heads.

One embodiment of the invention provides a system for controlling a miner. The system includes a cutter head, left and right tram systems, and a cutter head controller. The cutter head includes a plurality of bits and a plurality of sections defining at least one recess. The left and right tram systems are configured to move the miner, and the cutter head controller is configured to vary a current speed of at least one of the left tram system and the right tram system to cause the cutter head to alternate back and forth to bring the plurality of bits into engagement with material accumulating within the least one recess.

Another embodiment of the invention provides a computer-implemented method for controlling a miner, wherein the miner includes a cutter head including a plurality of bits and at least one recess, left and right tram systems configured to move the miner, and a cutter head controller. The method includes (a) setting, with the cutter head controller, an adjustment variable; (b) adjusting, with the cutter head controller, a current speed of at least one of the left tram system and the right tram system based on the adjustment parameter; (c) varying, with the cutter head controller, the adjustment parameter; and (d) repeating (b)-(c) to cause the cutter head to alternate back and forth to bring the plurality of bits into engagement with material accumulating within the least one recess.

Yet another embodiment of the invention provides non-transitory computer-readable medium encoded with a plurality of processor-executable instructions for controlling a miner, wherein the miner includes a cutter head including a plurality of bits and at least one recess and left and right tram systems configured to move the miner. The instructions include (a) setting an adjustment parameter; (b) adjusting a current speed of at least one of the left tram system and the right tram system based on the adjustment parameter; (c) varying the adjustment parameter; and (d) repeating steps (b)-(c) to cause the cutter head to alternate back and forth to bring the plurality of bits into engagement with material accumulating within the least one recess.

Other aspects of the invention will become apparent by consideration of the detailed description and accompanying drawings.

DETAILED DESCRIPTION

Figure 1A:
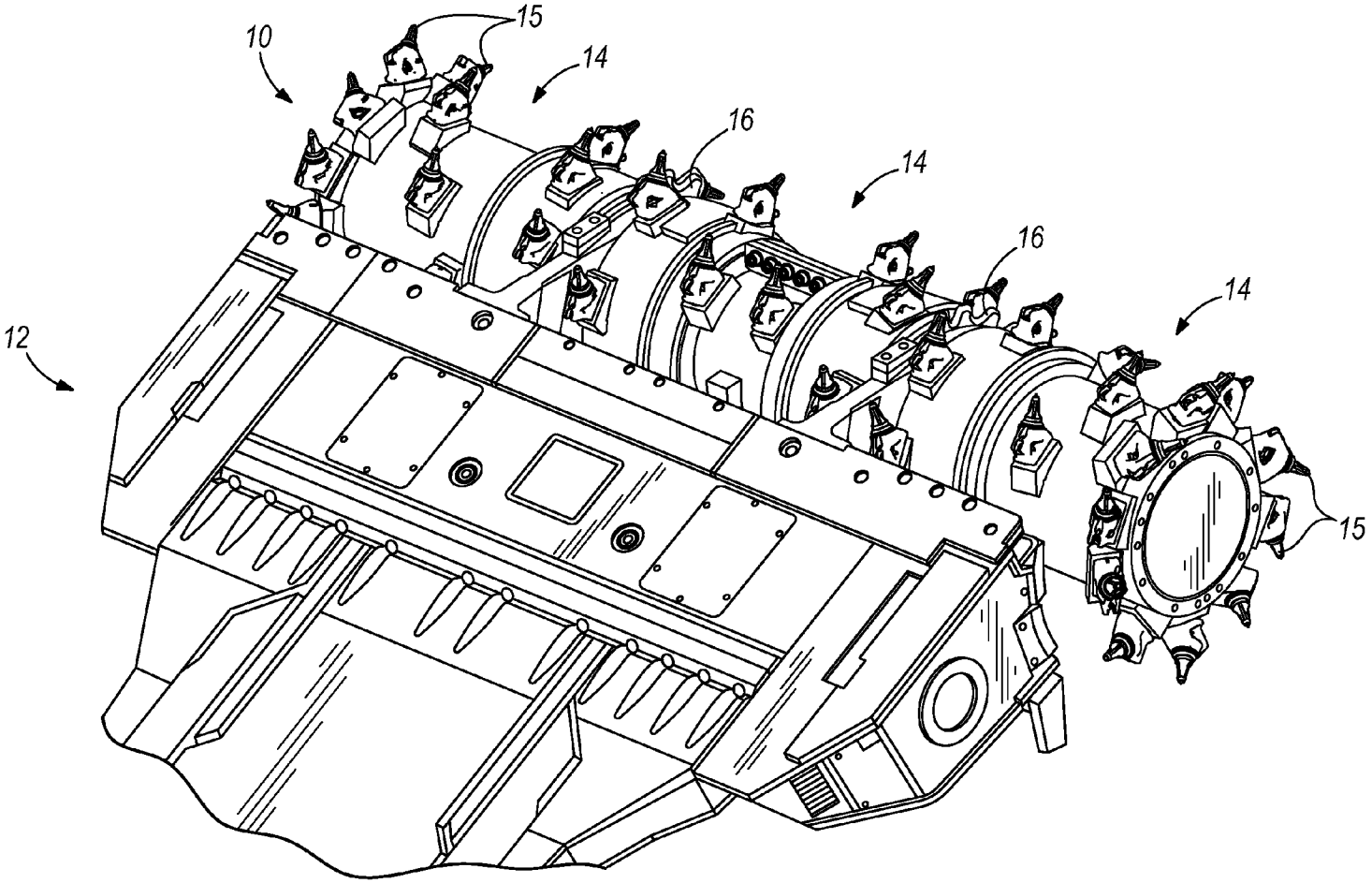
FIGS. 1A and 1B are perspective views of a cutter head of a continuous miner including core breakers according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium). As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

Figure 1B:
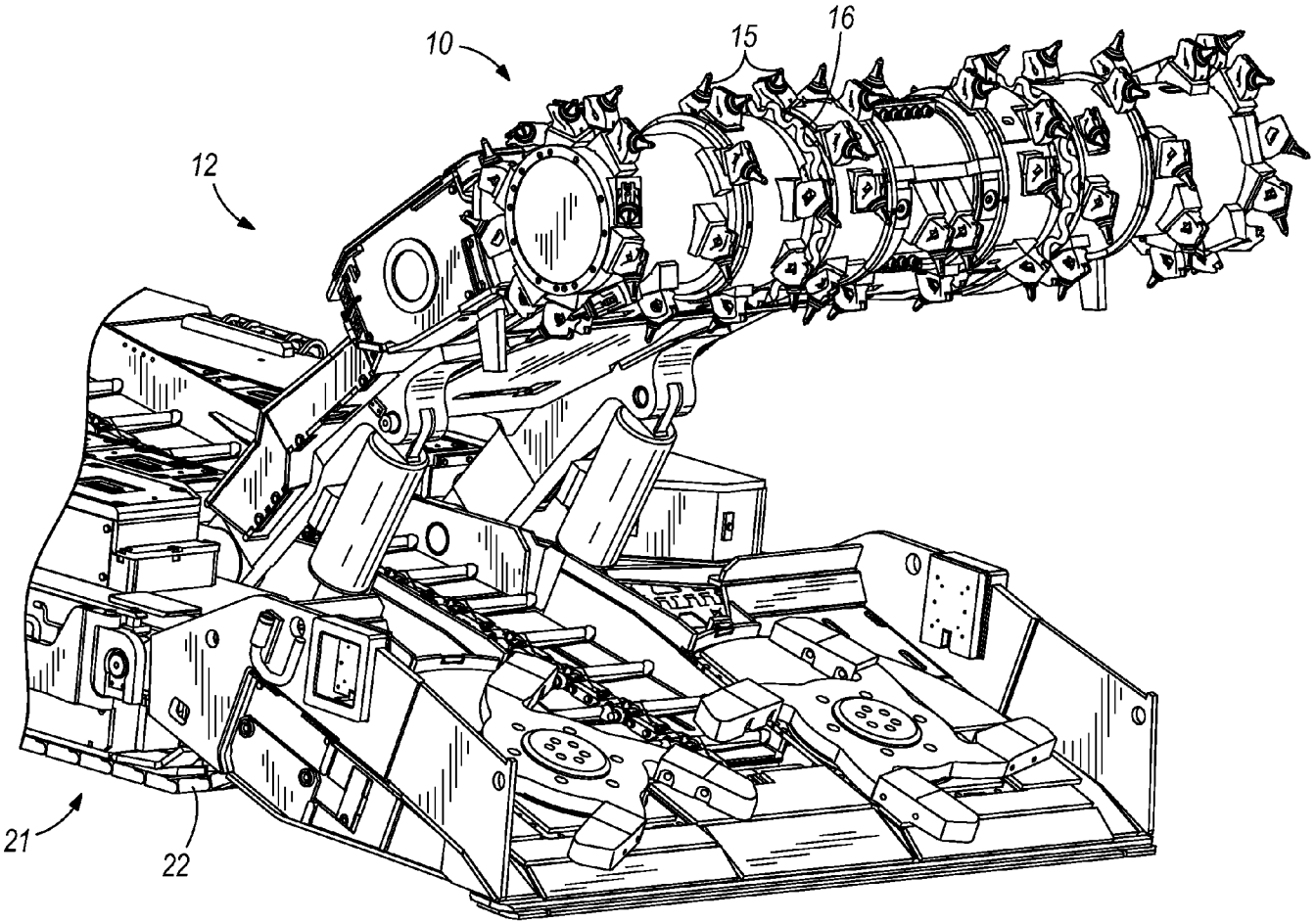
Figure 2:
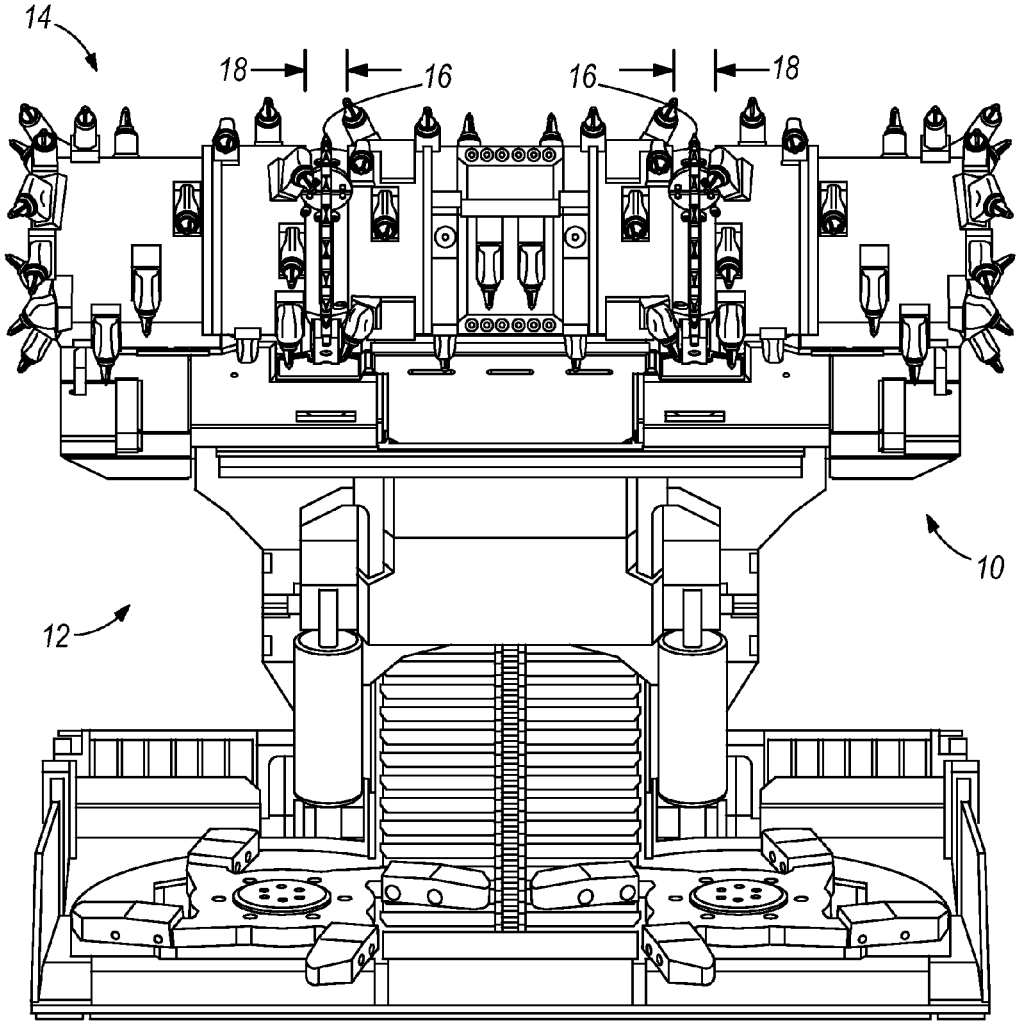
FIG. 2 is a front view of the cutter head of FIGS. 1A and 1B.
Figure 3:
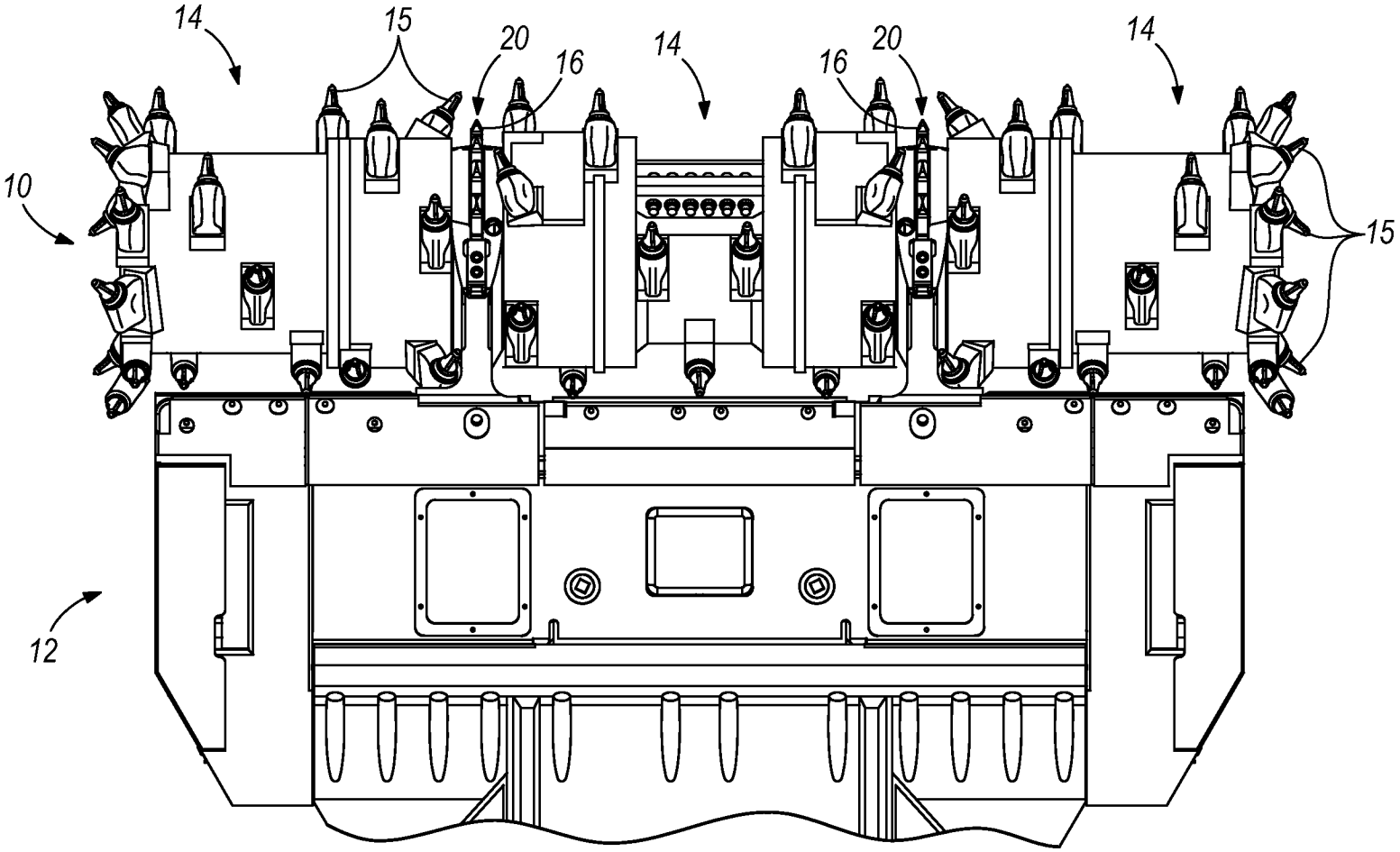
FIG. 3 is a top view of the cutter head of FIGS. 1A and 1B in operation where core in recesses between the sections of the cutter head is not cut.

FIGS. 1A and 1B illustrate a cutter drum or head 10 of a continuous miner 12 according to one embodiment of the invention. As shown in FIG. 1A, the cutter head 10 includes multiple sections 14 and each section 14 includes multiple bits 15. Between adjacent sections 14 is a core breaker ("CB") 16. Each CB 16 is positioned within a recess 18 formed between the cutter head sections 14 (see FIG. 2). The recess 18 is formed by the web of a cutter head gear case where the gearing comes through to drive the cutter head 10. As described above, the bits 15 cannot cut material entering the recesses 18, and the material left in the recesses 18 is often referred to as the core. For example, as shown in FIG. 3, core material (represented by triangles 20) entering the recesses 18 are out of reach of the bits 15 on the cutter head 10. Therefore, the core 20 accumulates in the recesses 18 and is not cut by the bits 15. If the core is made up of a soft material, the CB 16 positioned within each recess 18 can break up the core. However, if the core is made of harder material, the CB 16 can have trouble breaking the core, which impacts the performance of the miner 12.

As described in more detail below with respect to FIG. 6, when the CB 16 cannot effectively break up the core accumulating in the recesses 18, the cutter head 10 can alternate back and forth (e.g., left to right) when sumping into the material. This alternating or "wobble" movement allows the bits 15 to come into contact with the core 20 in the recesses 18. To perform this alternating movement, the left and right tram speeds of the cutter head 10 can be varied over a predetermined period of time to move the cutter head 10 to the left and the right as the miner 12 trams forward.

Figure 4:
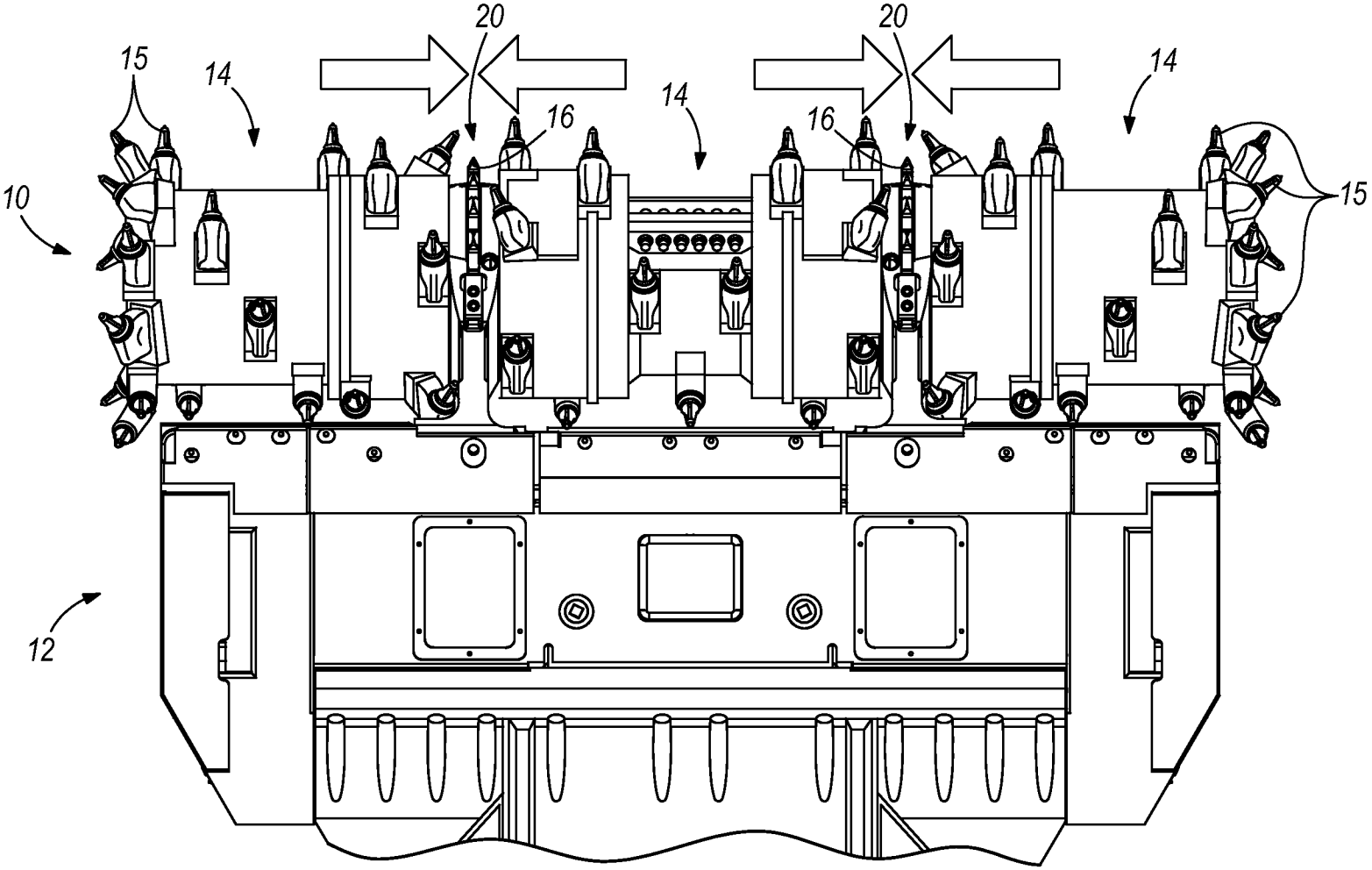
FIG. 4 is a top view of the cutter head of FIGS. 1A and 1B in operation where the left and right tram speed is varied to cut the core left in the recesses.

In particular, the continuous miner 12 includes a tram system including a track chain on each side of the miner 12 that can each be independently controlled to operate at the same or at different speeds. For example, as shown in FIG. 1B, the miner 12 can include a right tram system 21 including a right track chain 22. The miner 12 can include a corresponding left tram system including a left track chain on the opposite side of the miner 12. When set to the same speeds, the tram systems move the cutter head 10 in a forward direction. However, each tram system can move the cutter head 10 to the left or to right depending on whether the speed of the tram system is increased or decreased. For example, if the speed of the right tram system is decreased to be less than the speed of the left tram system, the left tram system is moving faster, which causes the cutter head 10 to move to the right. Similarly, if the speed of the left tram system is decreased to be less than the speed of the right tram system, the right tram system is moving faster, which causes the cutter head 10 to move to the left. By varying the left and right tram speeds while the miner 12 sumps into material, an alternating or "wobble" motion is created with the cutter head 10, which helps break up the core left in the recesses. In particular, using the "wobble" motion allows the core 20 to be attacked from both sides (as shown by the arrows in FIG. 4) to help break the core 20 with the cutter bits 15 to the left and right of the core 20 rather than straight on with a core breaker 16. In other embodiments, the speeds of particular drums or sections of the cutter head 10 can also be varied to cause the cutter head 10 to alternate back and forth.

Figure 5:
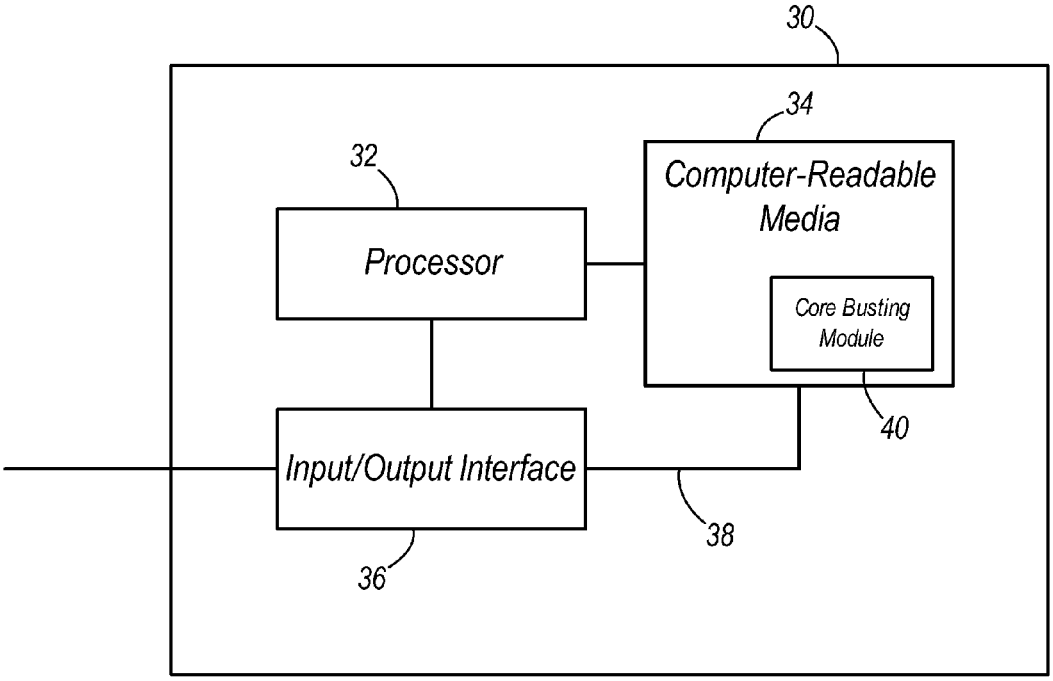
FIG. 5 schematically illustrates a cutter head controller for the cutter head of FIGS. 1A and 1B.

It should be understood that the cutter head 10 can be controlled by a cutter head controller. The cutter head controller can include electrical components, mechanical components, software components, or combinations thereof that control the operation of the cutter head 10. FIG. 5 schematically illustrates a cutter head controller 30 according to one embodiment of the invention. It should be understood that FIG. 5 illustrates only one example of components of a cutter head controller 30 and that other configurations are possible. As shown in FIG. 5, the controller 30 includes a processor 32, computer-readable media 34, and an input/output interface 36. The processor 32, computer-readable media 34, and input/output interface 36 are connected by one or more connections 38, such as a system bus. It should be understood that although only one processor 32, computer-readable media module 34, and input/output interface 36 are illustrated in FIG. 5, the controller 30 can include multiple processors 32, computer-readable media modules 34, and input/output interfaces 36. It should also be understood that the cutter head controller 30 can be combined with other controllers. For example, the cutter head controller 30 can be part of an overall controller for the miner 12.

The processor 32 retrieves and executes instructions stored in the computer-readable media 34. The processor 32 can also store data to the computer-readable media 34. The computer-readable media 34 can include non-transitory computer readable medium and can include volatile memory, non-volatile memory, or a combination thereof. In some embodiments, the computer-readable media 34 includes a disk drive or other types of large capacity storage mechanism.

The input/output interface 36 receives information from outside the controller 30 and outputs information outside the controller 30. For example, the input/output interface 36 can transmit signals, data, instructions, and queries to mechanical and electrical equipment located outside the controller 30 that operate and control the cutter head 10 or other components of the miner 12.

The instructions stored in the computer-readable media 34 can include various components or modules configured to perform particular functionality when executed by the processor 32. For example, the computer-readable media 34 can include a core busting module 40, as shown in FIG. 5. The core busting module 40 can be executed by the processor 32 to vary the left and right tram speeds of the cutter head 10 while the miner 12 trams forward. As described above, varying the tram speeds causes the cutter head 10 to alternate back and forth while sumping forward into the material. This alternating or "wobble" motion helps break up the core 20 accumulating in the recesses 18. As described below with respect to FIG. 6, an amplitude parameter can be used to determine the degree of the alternating movement of the cutter head 10, which determines how much the left and/or right tram speed is varied. A period parameter can also be used to determine the period of the "wobble" movement, which determines how long it takes for one "wobble" cycle to complete.

Figure 6:
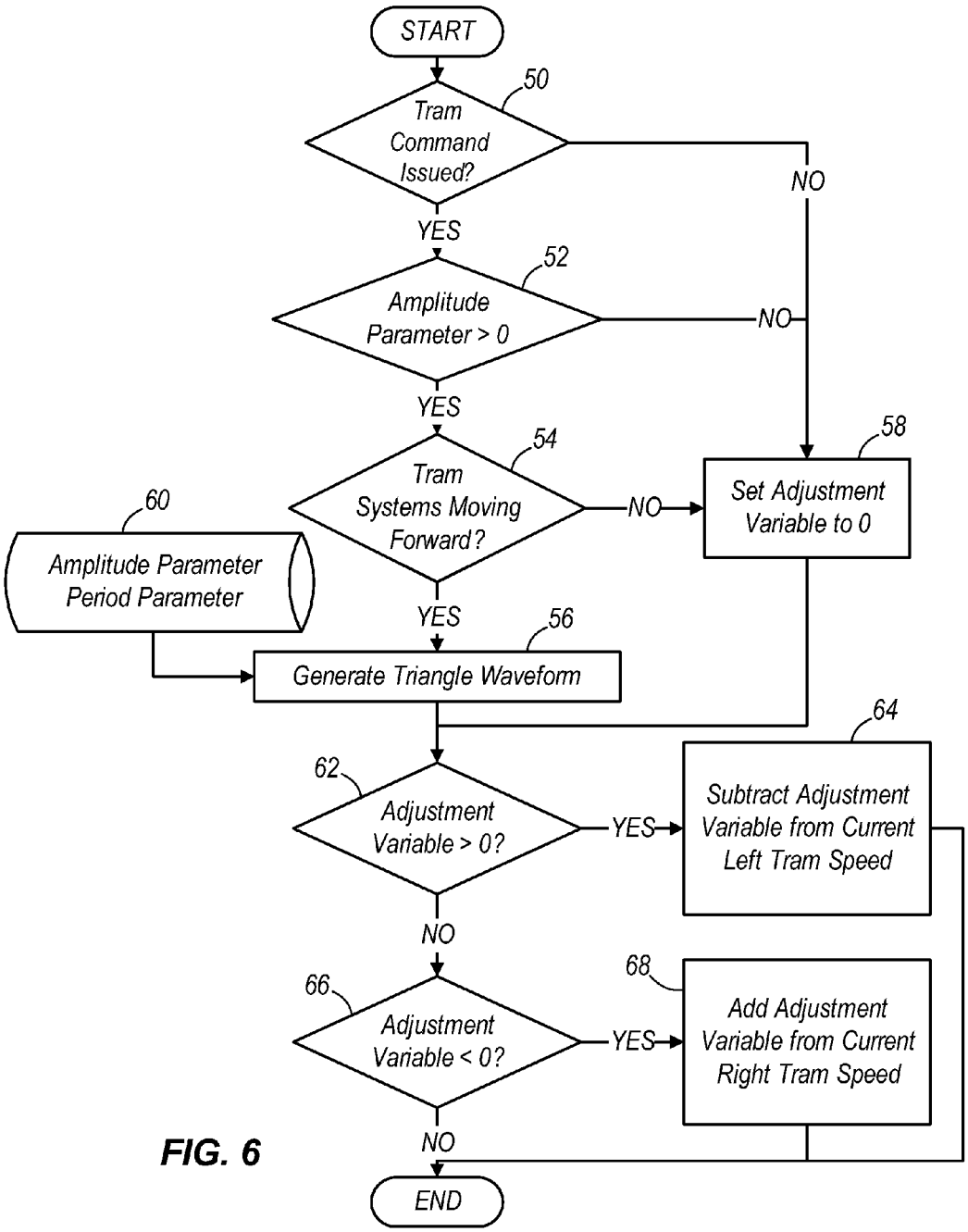
FIG. 6 is a flow chart illustrating a method performed by the cutter head controller of FIG. 5 to vary the left and right tram speed.

FIG. 6 is a flow chart illustrating a method performed by the controller 30 when the core busting module 40 is executed according to one embodiment of the invention. As shown in FIG. 6, the method starts by determining if an operator of the miner 12 has issued a tram command (at 50). When the operator issues a tram command, the method determines whether an amplitude parameter is set to a value greater than zero (at 52). Initially, when the core busting module 40 is loaded or executed, the amplitude parameter can be set to 0 and a period parameter can be set to 1 second. If the core becomes a problem and an operator desires to enable the "wobble" feature, an operator can set the amplitude parameter to a non-zero value via a graphical display (e.g., on the miner 12 or on a remote control station or device for the miner 12).

An operator can then set the amplitude parameter to a value indicating a degree of "wobble" the operator desires. The operator can also set the period parameter in a similar fashion. In some embodiments, the amplitude parameter can be set between 0 and 30 and can be set as a percentage of the maximum cutting speed of the miner 12. The value of one or both of the parameters can also be automatically set by the module 40 based on the operation of the miner 12 or various sensors detecting various parameters of the core. For example, the core busting module 40 can automatically determine a suggested amplitude and/or period parameter and can display the suggested parameter(s) to an operator for verification or manual override.

Figure 7:
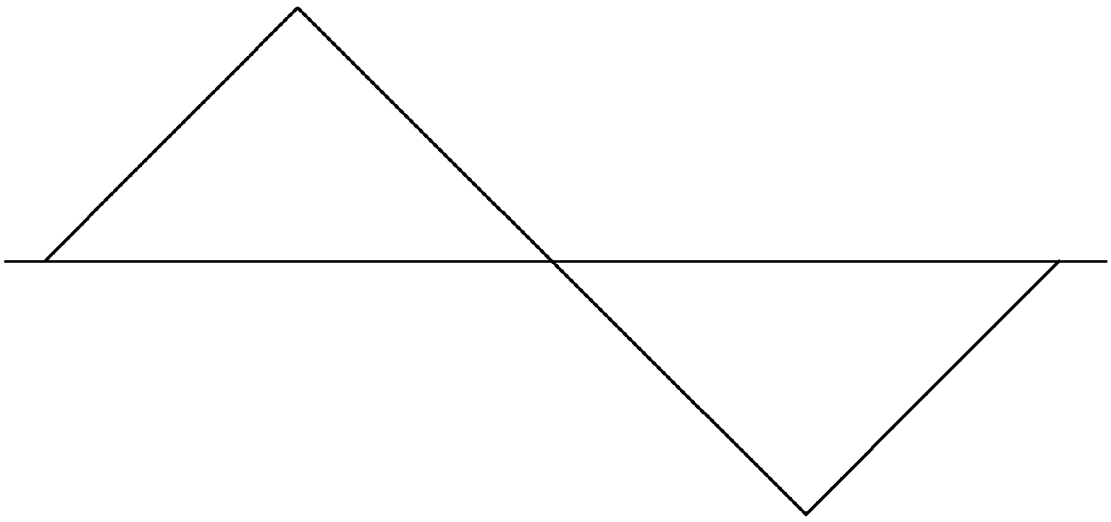
FIG. 7 illustrates a waveform according to one embodiment of the invention.

If the amplitude parameter has a value greater than zero, the method determines if the tram systems for the miner 12 are moving in a forward direction (at 54). If the tram systems are moving forward, the miner 12 is sumping forward into the material and the "wobble" feature should be started to handle core material accumulating in the recesses 18. Therefore, in some embodiments, the method generates a waveform (at 56), such as the triangle waveform illustrated in FIG. 7. As described below, the waveform is used to vary the speed of the left and right tram systems over a predetermined period of time to move the cutter head 10 to the left and to the right (e.g., "wobble" the cutter head 10) to break up the core. The module 40 generates the waveform based on the values of the amplitude parameter and the period parameter (i.e., as set by the operator or the module 40). For example, the waveform has a period and a current amplitude at various time intervals over the waveform period. The maximum amplitude of the triangle waveform can be approximately the value of the amplitude parameter, and the period of the waveform can be approximately the value of the period parameter (data 60).

Alternatively, as shown in FIG. 6, if the operator has not issued a tram command (at 50), the amplitude parameter is not greater than zero (at 52), or the tram systems are not moving in a forward direction (at 54), the miner 12 is not operating in a condition where core material accumulating in the recesses 18 is an issue. Therefore, in this situation, an adjustment variable, which is used by the module 40 as described below to vary the tram speeds, is set to zero (at 58) and a triangle waveform is not generated.

After the waveform is generated, the waveform is used to vary the left and right tram speeds of the cutter head 10 over a predetermined period. For example, the period of the waveform sets the predetermined time period over which the tram speeds are varied (i.e., the time that the "wobble" movement is performed), and the adjustment variable is set to the current amplitude of the waveform at each time interval during the waveform period. Therefore, initially, after the waveform is generated, the adjustment variable is set to the amplitude of the waveform at an initial time interval (e.g., the start of the waveform). Then, at each time interval over the period of the waveform, the value of the adjustment variable is reset to the amplitude of the waveform at that time interval.

At each time interval, the adjustment variable is then added to or subtracted from the current speed of the left or right tram to either increase or decrease the current speed of the left or right tram speed by the current amplitude of the waveform. When this is performed over the period of the waveform, the cutter head 10 alternates back and forth in a "wobble" motion that brings the bits 15 into engagement with the core 20. As the bits 15 attack the core 20 from the left and from the right during the "wobble" motion, the core 20 is cut and broken up, which allows the miner 12 to continue to effectively tram forward.

For example, as shown in FIG. 6, after the triangle waveform is generated (at 56) or the core breaker adjustment is set to zero (at 58), the method determines if the adjustment variable has a value greater than zero (at 62). As described above, if core busting is not needed, the adjustment variable is set to zero (at 58), but if core busting is desired, the adjustment variable is to the amplitude of the waveform at the current time interval. Therefore, if the adjustment variable has a value greater than zero, the module 40 subtracts the value of the adjustment variable from the current speed of the left tram to decrease the speed of the left tram by the value of the adjustment variable (at 64).

Alternatively, if the adjustment variable is not greater than zero (at 62), the method determines if the adjustment variable has a value less than zero (at 66). If the value of the adjustment variable is less than zero, the module 40 adds the negative value of the adjustment variable from the current speed of the right tram to decrease the speed of the right tram by the value of the adjustment variable (at 68). Therefore, if the adjustment variable has been set to zero (at 58), no adjustment is made to the current speed of the left or right tram by the core busting module 40. However, if the adjustment variable is set to a non-zero value, either the left or right tram speed is adjusted based on the adjustment variable to make one of the tram speeds greater than the other, which causes the cutter head 10 to either move to the left or to the right. It should be understood that subtracting the value of the adjustment variable from one tram is equivalent to adding the value of the adjustment variable from the other tram. For example, at 68, the value of the adjustment variable can either be added to the current speed of the right tram or subtracted from the current speed of the left tram to achieve a similar result (i.e., the cutter head 10 moves to the right). However, in some embodiments, it may be more efficient and/or safer to slow down a tram speed rather than speed up a tram speed.

After the speed of the left or right ram is varied based on the adjustment variable, the value of the adjustment variable can be adjusted or reset to the amplitude of the waveform at the next or subsequent time interval of the waveform period. This process can be repeated for the period of the waveform, which causes the cutter head 10 to alternate back and forth to engage the bits 15 with the core accumulating in the recess 18. After the entire waveform has been applied, the module 40 can repeat the method illustrated in FIG. 6 and a new waveform can be generated and applied if needed. Alternatively, the waveform initially generated by the module 40 can be reused or reapplied one or more times.

As previously mentioned, varying the speed of the left and right trams causes the cutter head to alternate back and forth. This "wobble" motion by the cutter head helps break up the core accumulating in the recesses 18, which makes the miner 12 more productive, especially when cutting hard material. Also, using the "wobble" motion may allow a miner 12 to use different types of cutter heads rather than ryperveyor style cutters, such as drum style cutter heads.

Also, it should be understood that generating a waveform is only one way to vary or alternate the speeds of the tram systems. For example, the trams speeds can be varied based on a constant value that can be applied for a predetermined period of time to each of the tram systems. For example, initially the right tram speed can be decreased by a desired amount for a predetermined period of time (which moves the cutter head 10 to the left) and then the left tram speed can be decreased by the desired amount for a predetermined period of time (which moves the cutter head 10 to the right). This can be repeated as much as needed to effectively break up the core accumulating in the recesses 18. Alternatively, the speeds of each tram system can be adjusted using different amounts (e.g., set automatically or manually) and/or the speed of each tram system can be adjusted for a different period of time.

This uneven alternating motion can create an uneven "wobble" where the cutter head 10 moves in one direction (i.e., the left or the right) more than in the opposite direction, which can move the entire miner 12 either to the left or to the right over an extended period of time. Also, in some embodiments, an operator can use a button or switch on a display to manually increase or decrease one of the tram speeds a predetermined amount for as long as the operator holds down or engages the button or switch.

Various features and advantages of the invention are set forth in the following claims.

What is claimed is:

1. A system for controlling a miner comprising:

a cutter head including a plurality of bits and a plurality of sections defining at least one recess;

left and right tram systems configured to move the miner;

a cutter head controller configured to vary a speed of at least one of the left tram system and the right tram system when the cutter head is operational to cause the cutter head to alternate back and forth to bring the plurality of bits into engagement with material accumulating within the least one recess.

2. The system of claim 1, wherein the cutter head controller is further configured to receive an amplitude parameter value from an operator.

3. The system of claim 2, wherein the cutter head controller is configured to vary the speed of at least one of the left tram system and the right tram system to alternate the cutterhead back and forth based on the amplitude parameter value.

4. The system of claim 1, wherein the cutter head controller is configured to vary the speed of at least one of the left tram system and the right tram system by generating a waveform having a period and a current amplitude at each of a plurality of time intervals over the waveform period.

5. The system of claim 4, wherein the cutter head controller is configured to vary the speed of at least one of the left tram system and the right tram system by applying the current amplitude at each of the plurality of time intervals to the speed of at least one of the left tram system and the right tram system over the period of the waveform.

6. The system of claim 5, wherein the cutter head controller is configured to apply the current amplitude at each of the plurality of time intervals to the speed of at least one of the left tram system and the right tram system over the period of the waveform by decreasing the speed of the left tram system by the current amplitude of the waveform.

7. The system of claim 6, wherein the cutter head controller is configured to decrease the speed of the left tram system by the current amplitude of the waveform when the current amplitude is greater than zero.

8. The system of claim 5, wherein the cutter head controller is configured to apply the current amplitude at each of the plurality of time intervals to the speed of at least one of the left tram system and the right tram system over the period of the waveform by decreasing the speed of the right tram system by the current amplitude of the waveform.

9. The system of claim 8, wherein the cutter head controller is configured to decrease the speed of the right tram system by the current amplitude of the waveform when the current amplitude of the waveform is less than zero.

10. A computer-implemented method for controlling a miner having a cutter head including a plurality of bits and at least one recess, left and right tram systems configured to move the miner, and a cutter head controller, the method comprising:

(a) setting, with the cutter head controller, an adjustment variable;

(b) adjusting, with the cutter head controller, a speed of at least one of the left tram system and the right tram system based on the adjustment variable;

(c) varying, with the cutter head controller, the adjustment variable; and (d) repeating (b)-(c) to cause the cutter head, during operation, to alternate back and forth to bring the plurality of bits into engagement with material accumulating within the least one recess.

11. The method of claim 10, further comprising receiving, at the cutter head controller, an amplitude parameter value from an operator.

12. The method of claim 11, wherein setting the adjustment variable and varying the adjustment variable includes setting the adjustment variable based on the amplitude parameter value and adjusting the adjustment variable based on the amplitude parameter value.

13. The method of claim 10, wherein setting the adjustment variable includes generating a waveform having a period and a current amplitude at each of a plurality of time intervals over the waveform period.

14. The method of claim 13, wherein setting the adjustment variable includes setting the adjustment variable to a current amplitude of the waveform.

15. The method of claim 14, wherein adjusting the current speed of at least one of the left tram system and the right tram system includes decreasing the speed of the left tram system by the adjustment variable.

16. The method of claim 15, wherein decreasing the speed of the left tram system by the adjustment variable includes decreasing the speed of the left tram system by the adjustment variable when the current amplitude of the waveform is greater than zero.

17. The method of claim 14, wherein adjusting the current speed of at least one of the left tram system and the right tram system includes decreasing the speed of the right tram system by the adjustment variable.

18. The method of claim 17, wherein decreasing the speed of the right tram system by the adjustment variable includes decreasing the speed of the right tram system by the adjustment variable when the current amplitude of the waveform is less than zero.

19. The method of claim 17, wherein varying the adjustment variable includes setting the adjustment variable to a current amplitude of the waveform at a subsequent time interval.

20. Non-transitory computer-readable medium encoded with a plurality of processor-executable instructions for controlling a miner having a cutter head including a plurality of bits and at least one recess and left and right tram systems configured to move the miner, the instructions comprising:

(a) setting an adjustment variable;

(b) adjusting a speed of at least one of the left tram system and the right tram system based on the adjustment variable;

(c) varying the adjustment variable; and (d) repeating steps (b)-(c) to cause the cutter head, during operation, to alternate back and forth to bring the plurality of bits into engagement with material accumulating within the least one recess.

21. The computer-readable medium of claim 20, further comprising instructions for receiving an amplitude parameter value from an operator.

22. The computer-readable medium of claim 21, wherein the instructions for setting the adjustment variable include instructions for generating a waveform based on the amplitude parameter, the waveform having a period and a current amplitude at each of a plurality of time intervals over the waveform period.

23. The computer-readable medium of claim 22, wherein the instructions for setting the adjustment variable include instructions for setting the adjustment variable to a current amplitude of the waveform at a current time interval.

24. The computer-readable medium of claim 23, wherein the instructions for adjusting the speed of at least one of the left tram system and the right tram system include instructions for decreasing the speed of at least one of the left tram system and the right tram system by the adjustment variable.

25. The computer-readable medium of claim 24, wherein the instructions for varying the adjustment variable include instructions for setting the adjustment variable to a current amplitude of the waveform at a subsequent time interval.

* * * * *